US005533218A

United States Patent [19]

Fahy

[11] Patent Number: 5,533,218

[45] Date of Patent: Jul. 9, 1996

[54] CUSHIONING DEVICES

[76] Inventor: Arthur J. Fahy, 2 Warren Road, Double Bay, Sydney, New South Wales, Australia

[21] Appl. No.: 363,407

[22] Filed: Dec. 23, 1994

[30] Foreign Application Priority Data

| | | | |
|---|---|---|---|
| Jul. 15, 1994 | [AU] | Australia | PM6868 |
| Aug. 24, 1994 | [AU] | Australia | PM7682 |
| Oct. 28, 1994 | [AU] | Australia | PM9149 |

[51] Int. Cl.[6] ..... A47G 9/02

[52] U.S. Cl. ..... 5/636; 5/643; 5/481

[58] Field of Search ..... 5/636, 464, 468, 5/481, 490, 643

[56] References Cited

U.S. PATENT DOCUMENTS

| | | | |
|---|---|---|---|
| 3,885,257 | 5/1975 | Rosers | 5/464 |
| 4,064,578 | 12/1977 | Yamada | 5/481 |
| 4,726,087 | 2/1988 | Schaefer et al. | 5/636 |
| 4,916,765 | 4/1990 | Castronovo, Jr. | 5/636 X |
| 5,388,296 | 2/1995 | Mansour | 5/636 |

*Primary Examiner*—Michael F. Trettel
*Attorney, Agent, or Firm*—Smith-Hill and Bedell

[57] ABSTRACT

A pillow core (1) is made from a foamed plastics material which is softly resilient, and has its upper thickness formed with upright parallel ribs (5) spaced from one another by slots of elongated cross-section. The ribs have their upper surfaces attached to the underside of a porous web (3) which is soft and flexible but relatively inextensible in its own plane. The lower thickness of the core (1) is formed with cylindrical sockets (11) containing removable plugs (14) of foamed plastics material removable from their sockets through respective slits (12) formed in the underside of the core. The upper thickness of the core gives the pillow surface a soft plush feel, and the plugs are selectively removable to alter the resistance to compression of the pillow.

14 Claims, 4 Drawing Sheets

CUSHIONING DEVICES

FIELD OF THE INVENTION

This invention relates to cushioning devices such as pillows and mattresses as well as general upholstery items such as cushions and seat swabs, and is more specifically concerned with such devices when made of a foamed plastics material.

STATE OF THE ART

Attempts have been made to simulate the comfort of a stuffed pillow or a sprung mattress with a foamed plastics device. Foamed plastics has the advantage of a long life and being resistant to insect infestation. However it also has disadvantages caused by its inherent constant overall resilience and a lack of a 'plush' feel to its surface.

In the case of a foam pillow the inherent resilience of the foam gives it a characteristic known in the trade as "fight back". The fight-back characteristic inherently resists small movements of the sleeper's head and eventually produces discomfort in the sleeper's neck because the pillow is incapable of 'nesting' the sleeper's head comfortably when small angular changes in the position of the sleeper's head occur.

Attempts have been made to simulate the soft feel of a stuffed pillow by forming the upper surface of a foam pillow with parallel ribs which yield more easily than the remainder of the pillow when subjected to load. However these ribs can be felt through the pillow cover by the sleeper's head. It has been proposed to reduce the space between the upper surfaces of the ribs so that they are not so easily felt, by forming inverted key-hole slots between them. This expedient has been found to work unsatisfactorily in practice, as the enlarged heads of the ribs flex over when the sleeper's head rests upon them, and then tend to lock under one another when the sleeper's head is raised. This produces resultant irregularities in the smooth surface profile of the pillow which are detected as soon as the sleeper's head is again placed on the pillow, and this again produces discomfort.

Cushioning devices such as pillows and mattresses are also required to provide a high degree of personal comfort to the user. However the personal preference of the user as regards the softness and resilience of the device, vary from one person to another. It is also dependent, to some extent, on the shape and weight of different parts of the anatomy of the user. The manufacturer either designs a particular device to meet the requirements of the largest segment of the market, or designs a range of such devices each adapted to satisfy a different segment of the market. It is left to the customer to purchase the device he or she considers to meet his or her particular requirements. This is not always an easy choice to make in a shop. Also, over a period of time, the customer's requirements may change, so that the device is no longer as comfortable as it was when bought.

OBJECTS OF THE INVENTION

An object of this invention is to produce an improved cushioning device made of foamed plastics material.

A second object of this invention is to provide a cushioning device made from a soft foamed plastics or an equivalent material and which is capable of having its stiffness altered during its useful life, to meet different personal requirements of the user.

THE INVENTION

In accordance with the present invention a cushioning device made of a resilient foamed plastics material has its upper thickness formed with parallel upright ribs separated from one another by parallel slots and which yield and bend over resiliently when a weight is placed on the upper surface of the device, the upper surfaces of the ribs being interconnected by a soft, thin, flexible, porous and preferably resilient layer which urges the ribs to their original upright positions when the weight is removed from the upper surface of the device.

In accordance with a second feature of the invention a cushioning device is provided with sockets at selected positions and spongy plugs may be removably located in respective sockets. The plugs are conveniently made from the same material as the cushioning device.

PREFERRED FEATURES OF THE INVENTION

The plugs can be individually manually removed from the sockets or replaced therein to adapt the device's stiffness to suit the comfort requirements of the user.

The cushioning device has the advantage that it can be manufactured in a standard form and its adjustment to suit the requirements of the user, can be left to the user. A single cushioning device can thus meet the comfort needs of several different segments of the market. This enables the device to have enhanced sales.

If the device is a core of a pillow, it can be provided in its under body with parallel transverse channels of C-shaped or O-shaped cross-section formed by cutting plugs out of the pillow during its manufacture. The pillow can be sold in a snugly-fitting zippered pillow slip which holds the plugs in the channels from which they were cut. The purchaser of the pillow can alter the stiffness of the pillow he has purchased, in the privacy of his home, by opening up the pillow slip at one end and removing selected plugs until the softness and resilience of the pillow suits his particular requirements.

The plugs are preferably cylindrical in shape and fit snugly in their respective sockets from which they can be withdrawn via slits extending between the sockets and the underside of the pillow. The slits can be opened up, to facilitate insertion or withdrawal of the plugs, by manually bowing the sides of the pillow upwardly. The upright lengths and thicknesses of the ribs in the upper thickness of the pillow and their cross-sectional shape, may be varied so as to provide the device with surface zones of different degrees of softness.

In one arrangement of carrying out the invention, the layer interconnecting the upper surfaces of the ribs is integral with the ribs, so that all of the component parts of the pillow are made from the same material. In an alternative and preferred arrangement, the layer comprises a thin, porous plastics web which is cemented or glued to the upper surfaces of the ribs. The body of the pillow and the ribs are then made of one material and the plastics web is conveniently made from a different material, or a different density of the same material.

The parallel slots between the ribs may be used to enhance the versatility of the device by accommodating flexible elongated members which enable the device to perform different functions. For example, it is sometimes necessary to vary the resilience of different surface zones of the device. This is particularly so when the device is constructed as a mattress having parallel ribs extending either from end-to-end or from side-to-side. Flexibly-walled tubes may be provided in the slots and connected to a source of pressure fluid which may be liquid or gaseous. Selectively inflating the tubes in different surface zones of the mattress to different extents, will vary the stiffness of the surface zones of the mattress above the more inflated tubes. The tubes may be elastically walled if desired and may be arranged in two strata in the pillow.

The tubes in one stratum extend in a direction which is perpendicular to the tubes extending in the second stratum. Naturally the device has parallel openings extending through it in each of the stratum.

In another arrangement the flexible elongated members comprise electrical heating wires so that the mattress can be used to provide heat to a bed. The use of a foam plastics mattress incorporating heating means makes the use of a separate electric blanket unnecessary.

Naturally a mattress might be constructed with the slots containing both the electrical heating wires and the thin-walled tubes, possibly with alternate slots carrying the wires and the remaining slots carrying the tubes.

INTRODUCTION TO THE DRAWINGS

The invention will now be described in more detail, by way of examples, with reference to the accompanying drawings, in which:

IN THE DRAWINGS

Figure 7:
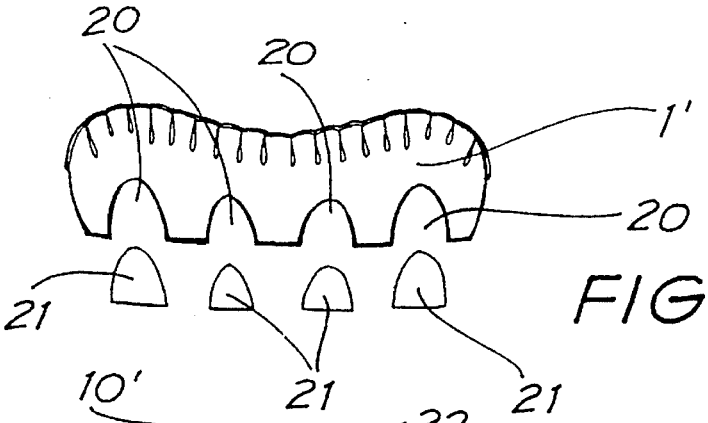
FIG. 7 is an end view of the pillow core of FIG. 5, showing stiffening plugs displaced beneath it.
Figure 8:
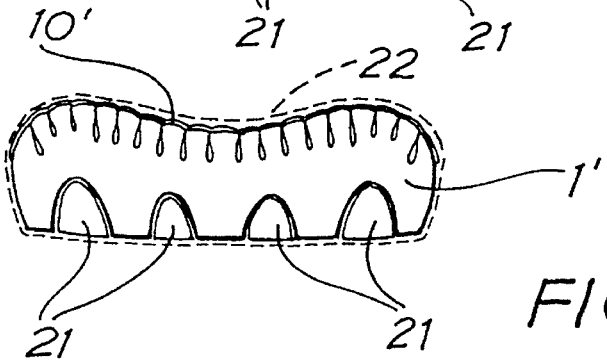
Figure 9:
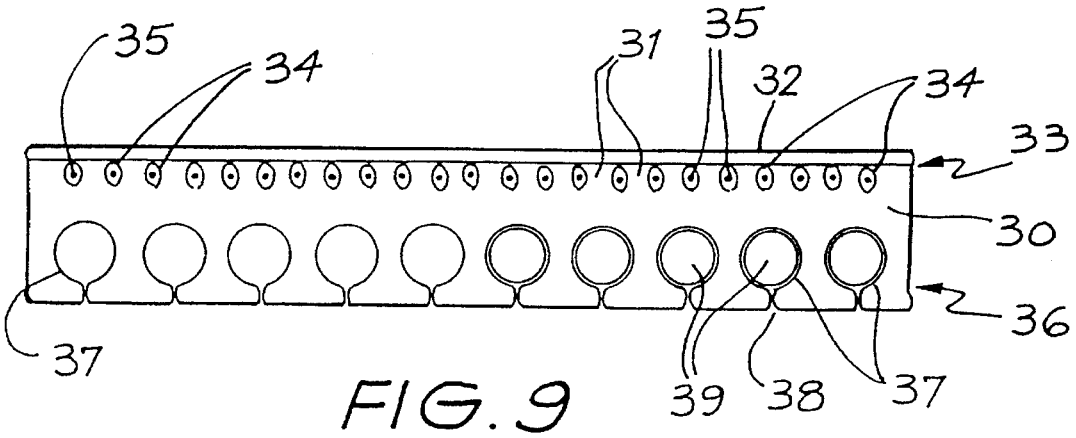

FIG. 8 shows the pillow core of FIG. 7 with the stiffening plugs in position and encased in a surrounding line pillow slip shown in broken outline; and, FIG. 9 is an end view of a mattress core having longitudinal elements for heating or varying the surface stiffness of the mattress, and plugs and sockets for varying the resistance to compression of the left-hand side of the mattress as compared with the right-hand side.

DESCRIPTION OF THE FIRST EMBODIMENT

Figure 1:
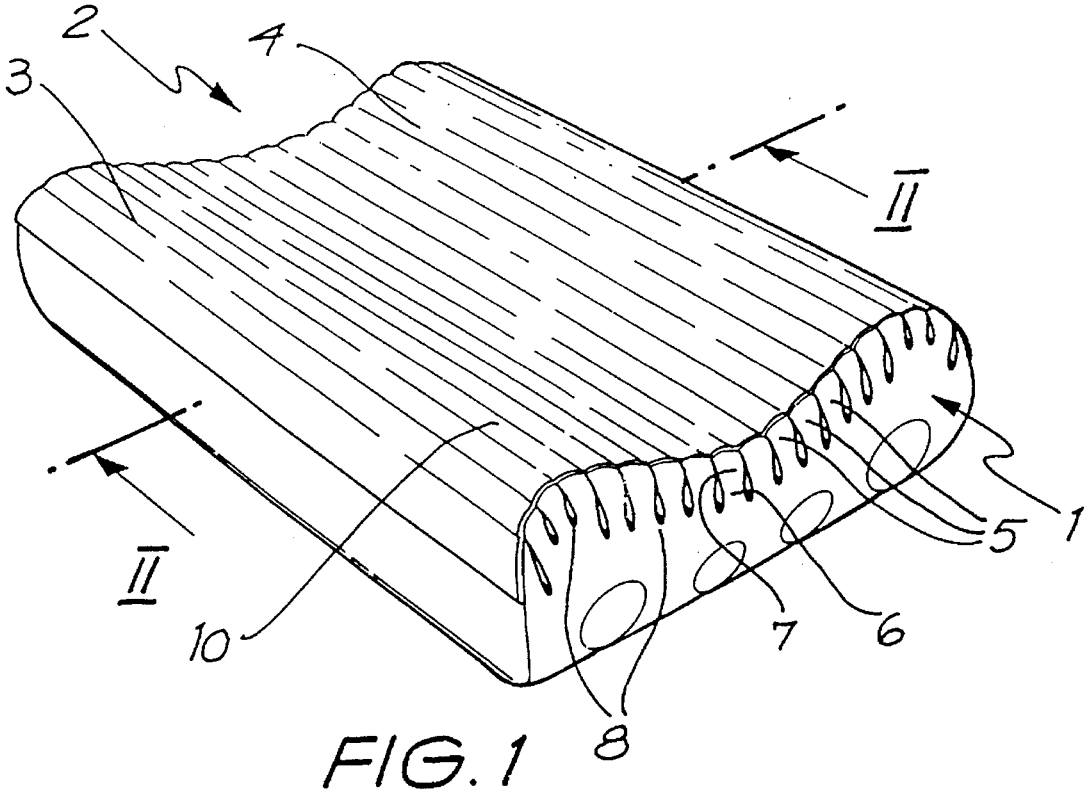
FIG. 1 shows, in perspective, a cushioning device formed as a pillow core for placing within a pillow slip (not shown)

FIG. 1 shows a pillow core 1 made of softly resilient foamed plastics material. Its upper surface is contoured to provide a gentle valley 2 between two parallel mounds referenced 3 and 4.

The upper thickness of the pillow core 1 is formed with a line of parallel ribs 5 extending between opposite ends of the core and each having a stem portion 6 and a thicker head portion 7. The ribs 5 are formed by cutting into the upper thickness of the core 1 with an abrasive cutting wire which moves along a generally elliptically path so as to provide slots 8 which separate the stem portions 6 of the respective ribs while the head portions 7 nearly touch one another.

Figure 2:
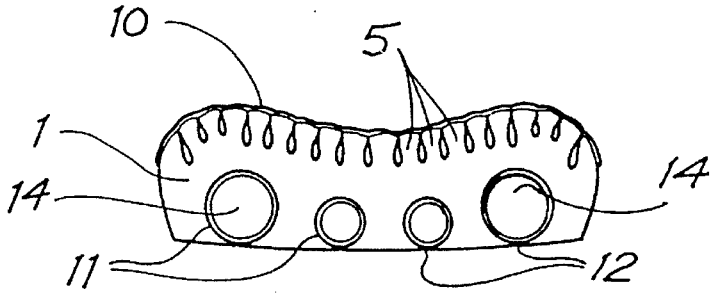
FIG. 2 is a section through the pillow taken on the line and in the direction indicated by the arrows II—II in FIG. 1.

A thin porous web 10 provides a layer which covers the top surface of the pillow core 1. The web 10 is cemented to the upper, convex surfaces of the head-portions 7 of the ribs 6 as is shown more clearly in FIG. 2. The web 10 is flexible and resilient in its own plane so that it holds the head-portions 7 of the ribs 5 in a way which prevents them locking beneath one another after being bent and compressed downwardly by a sleeper's head when resting on the pillow.

Figure 3:
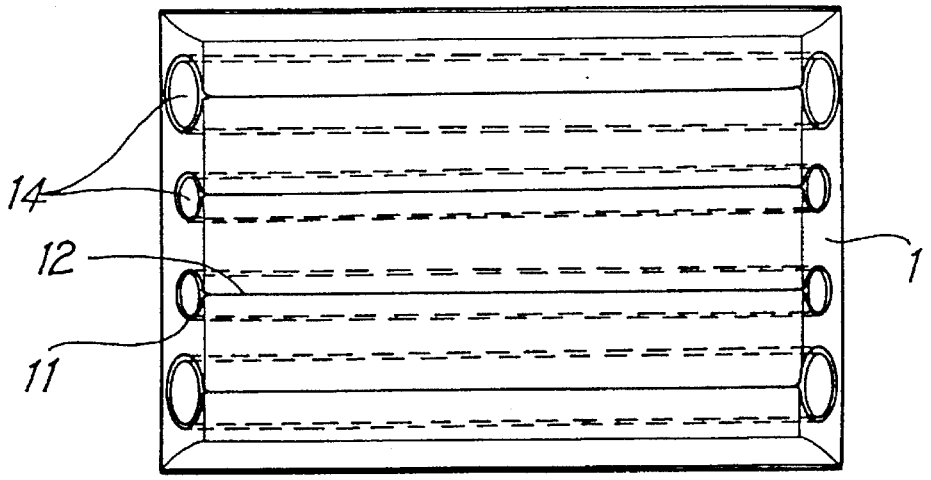
FIG. 3 is an underview of the pillow core of FIG. 1.
Figure 4:
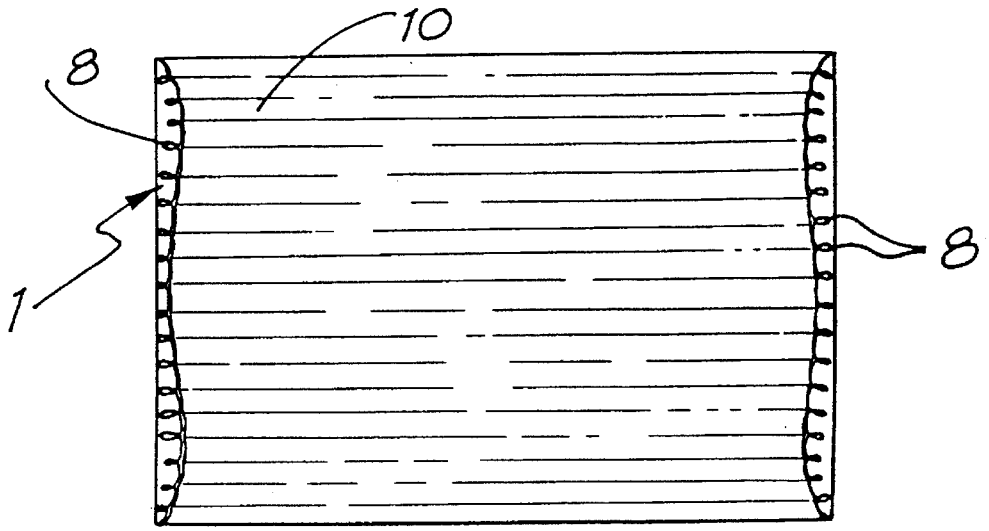
FIG. 4 is a top plan view of the pillow core of FIG.1.

The lower thickness of the pillow is formed with a number of cylindrical sockets 11 which open through a slit 12 in the underside of the pillow as is shown more clearly in FIG. 3. The sockets 11 are of different sizes. They are also formed by a cutting wire which enters the material of the pillow core 1 during its fabrication, by way of the slit 12 and then follows a circular path to cut out a cylindrical plug 14 which may thereafter be removed from the socket 11 by way of the slit 12. The plugs 14 are thus made from the same material as the remainder of the pillow core 1 but, if desired, they may be made from a material having a different stiffness.

OPERATION OF THE FIRST EMBODIMENT

The pillow core is normally placed inside a fabric pillow case before being used. The user of the pillow adjusts the compressibility of the pillow to suite his personal preference, by removing one or more of the plugs 14 from their sockets 11 at the positions which the user requires the pillow to be softer. The plugs 14 are easily removed from their sockets by stripping them out through the slits 12. Likewise, if at some future date the user wishes the pillow to be stiffened in an area from which a plug 14 has been removed, he can quickly re-insert the plug into its socket 11. Once in position, the natural surface roughness of foamed plastics holds the plug in the socket.

When the user places his head upon the pillow, the weight of the head is transferred by the web 10 to the ribs 5. These yield easily in compression and bending, as a result of the slots 8 between their stem portions 6. This gives the pillow a plush, feel which nests the user's head comfortably and the enhanced softness of the pillow's surface avoiding the irritating "fight-back" characteristic of conventional foam pillows. It is thus much more comfortable.

When the user raises his head, the ribs 5 return from their compressed state to the positions shown in FIG. 1. The web 10 assists this recovery by preventing the head portions 7 of the ribs 5 locking beneath each another.

DESCRIPTION OF THE SECOND EMBODIMENT

The second embodiment of pillow core shown in FIGS. 5 to 8 has its upper thickness similarly constructed to the embodiment already described. This part of the pillow core has therefore been identically referenced but the references been primed. They will not be again described to avoid needless repetition of description.

Figure 5:
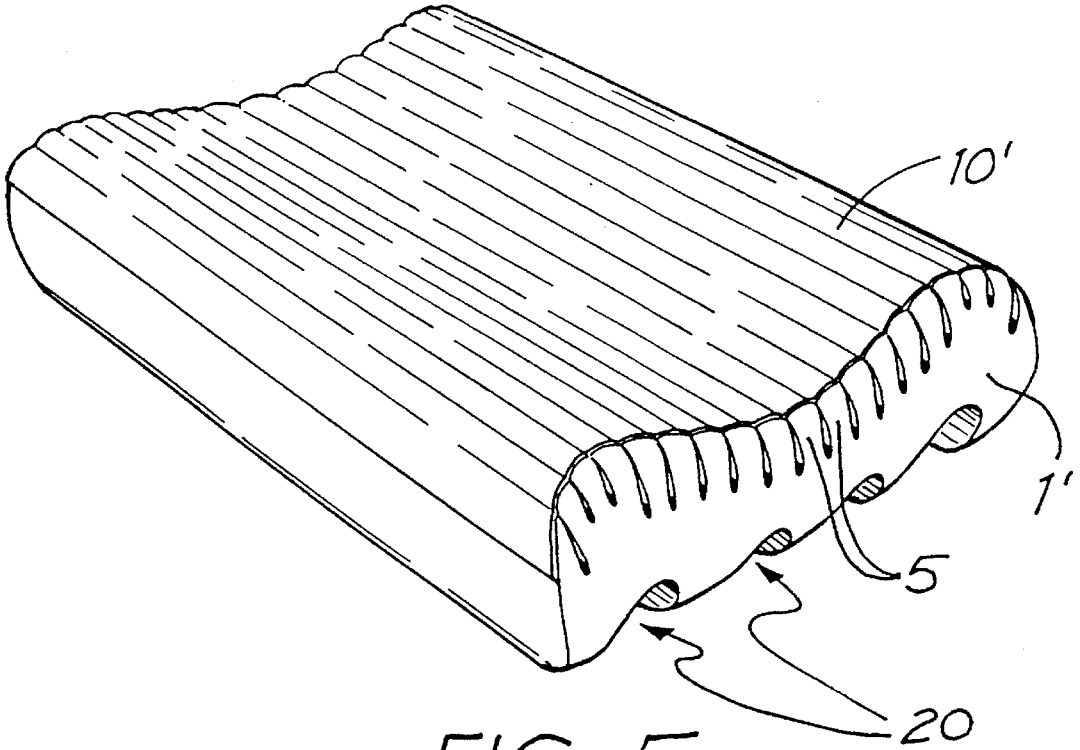
FIG. 5 is a perspective view of an alternative construction of pillow core.
Figure 6:
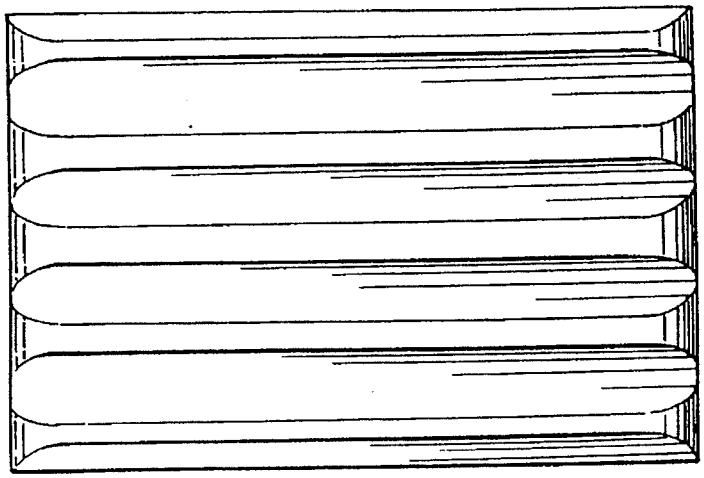
FIG. 6 is an underplan view of the pillow core of FIG. 5.

In the embodiment of FIG. 5, the under thickness of the core 1—has four inverted C-shaped channels 20 cut out of it as shown more clearly in FIGS. 7 and 8. These channels 20 make the pillow more compressible and thus softer at the positions where the channels are located. The cut out portions or plugs 21 may be retained and replaced by the purchaser in the pillow core 1 in order to increase its stiffness to compression. Although one might assume that the plugs 21 will fall out of their corresponding channels 20, this is not the case as the natural roughness of the foam material of the plugs 21 and the core 1 holds the plugs in the channels even when the core 1 is lifted up. Retention of the plugs 21 in the channels 20 is in any case achieved by a surrounding pillow case 22, shown in broken outline in FIG. 8.

OPERATION OF THE SECOND EMBODIMENT

The second embodiment operates in the same way as the first embodiment.

DESCRIPTION OF THIRD EMBODIMENT

FIG. 9 shows a cushioning device in the form of a mattress as viewed from one end. The mattress comprises a foamed plastics core 30 formed on its upper surface with longitudinally extending ribs 31 which correspond to the ribs 5 of FIG. 2. They will not therefore be again described. The upper surfaces of the ribs 31 are cemented to the underside of an elastic porous flexible web 32 which corresponds to the web 10 of FIG. 1 and serves the same function.

The ribs 31 are separated from one another in the upper thickness 33 of the mattress core 30, by longitudinally extending slots 34. These are formed in the same way as the slots 8 of FIG. 1.

Selected slots 34 contain longitudinally extending elements 35 which can be used to control the characteristics of the pillow. The elements 35 can be omitted if desired. They may take the form of inflatable tubes. By dilating these tubes, the surface stiffness of the mattress core 30 can be increased. Likewise the elements 34 may comprise insulated heating wires connected at their ends to a terminal connector (not shown) so that they mattress can be internally heated in winter, so that the use of an electric blanket is avoided. The configuration of the heating elements within the insulative foam core material of the mattress enhances the insulation between the conductors of the heating elements and the body of a person asleep on the mattress.

The mattress core 30 has its lower thickness 36 provided with a number of cylindrical sockets 37 opening through the underside of the mattress by way of respective slits 38 and containing foam plugs 39 which can be inserted into the sockets 37 manually, and removed therefrom by way of the slits 38. The sockets 37 are all of the same diameter. The plugs 39 serve the same function as the plugs 14 in FIG. 2, and likewise the sockets 37 correspond to the sockets 11 and the slits 38 correspond to the slits 12 of FIG. 3.

OPERATION OF THE THIRD EMBODIMENT

The mattress shown in FIG. 9 can have its stiffness varied by selective removal of the plugs 39 from their associated sockets 37. Thus the user can adjust the compressibility of the mattress to suit his personal preference.

If the mattress is intended for use on a double bed, the plugs 39 on one side can be removed to make that side of the bed softer, so that the mattress can accommodate the personal preferences of the two users sleeping on it at the same time.

The mattress of FIG. 9 is particularly advantageous for use in hospitals and for orthopaedic purposes. The ability to stiffen the surface feel of the mattress by inflating the tubular elements 34, and to control the temperature of the mattress through the use of the heating elements 34 extending through its surface thickness 33, gives the mattress versatility.

MODIFICATIONS TO THE PREFERRED EMBODIMENTS

The number of sockets accommodating the plugs can obviously be varied to suit the pillow characteristics required. Likewise the cross-sectional shape of the sockets and/or the plugs can be varied.

Although the invention has been particularly described with reference to bedding items, it is equally useful in other fields where enhanced surface plushness and different stiffnesses are required, such as seat swabs in vehicles and elsewhere, and cushions.

Finally the cross-sectional shapes of the ribs and the slots may be varied to give different compressive characteristics to the upper surface of the device.

Although the web is preferably resilient in its own plane, this is not essential and the layer formed by the web may be non-yielding in its own plane.

I claim:

1. A cushioning device made of a resilient foamed plastic material, the cushioning device having a lower thickness and an upper thickness, the upper thickness being covered by a continuous, soft, thin, flexible layer, and there being parallel slots in the upper thickness, whereby the upper thickness is divided into ribs, and in which said layer is made of a material that is different from that of said ribs, is cemented to said ribs; and is resilient in its own plane.

2. A device as set forth in claim 1, in which said ribs have upper portions and lower portions and said slots are disposed between and separate at least said lower portions of said ribs; and said upper portions of said ribs are thicker than said lower portions of said ribs.

3. A device as set forth in claim 2, having an upper surface contoured to provide a central elongated shallow valley between two parallel mounds, and said ribs cover the mounds and the valley and their lower portions extend substantially parallel to one another.

4. A device as set forth in claim 2, having parallel elongated recesses providing sockets in said lower thickness of said device.

5. A device as set forth in claim 4, said device having an underside and in which said recesses communicate along their lengths with the underside of the device.

6. A device as set forth in claim 5, including resilient foamed plastics plugs locatable in and removable from said recesses.

7. A device as set forth in claim 6, in which said plugs are made from the same material as that of the device surrounding said recesses.

8. A device as set forth in claim 7, in which said recesses are cylindrical.

9. A device as set forth in claim 8, in which said recesses extend parallel to said ribs.

10. A device as set forth in claim 1, wherein said layer is porous.

11. A device as set forth in claim 10, wherein said layer is cemented to the upper thickness of the cushioning device.

12. A device as set forth in claim 1, wherein said layer is made of the same material as the upper thickness and is integral therewith.

13. A cushioning device made of a resilient foamed plastic material, the cushioning device having a lower thickness and an upper thickness, the upper thickness being covered by a continuous, soft, thin, flexible, porous layer cemented to the upper thickness of the cushioning device, and there being parallel slots in the upper thickness, whereby the upper thickness is divided into ribs.

14. A cushioning device made of a resilient foamed plastic material, the cushioning device having a lower thickness and an upper thickness, the upper thickness being covered by a continuous, soft, thin, flexible layer that is made of the same material as the upper thickness and is integral therewith, and there being parallel slots in the upper thickness, whereby the upper thickness is divided into ribs.

* * * * *